US007086262B2

(12) United States Patent
Suzuki et al.

(10) Patent No.: US 7,086,262 B2
(45) Date of Patent: Aug. 8, 2006

(54) ELECTRIC PRESS

(75) Inventors: Shinji Suzuki, Tokyo (JP); Shinichi Kato, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 56 days.

(21) Appl. No.: 10/955,771

(22) Filed: Sep. 30, 2004

(65) Prior Publication Data

US 2005/0081587 A1 Apr. 21, 2005

(30) Foreign Application Priority Data

Oct. 21, 2003 (JP) ..... 2003-360232

(51) Int. Cl.
*B21J 9/20* (2006.01)
*B30B 15/26* (2006.01)

(52) U.S. Cl. ..... 72/20.1; 100/43; 100/348

(58) Field of Classification Search ..... 72/15.1, 72/20.1, 20.2, 21.1, 21.3, 712; 100/43, 48, 100/49, 341, 342, 348, 280

See application file for complete search history.

(56) References Cited

U.S. PATENT DOCUMENTS 5,880,954 A * 3/1999 Thomson et al. ..... 700/79
6,047,634 A * 4/2000 Futsuhara et al. ..... 100/43
6,145,366 A * 11/2000 Yamada ..... 72/443
6,660,993 B1 * 12/2003 Appleyard et al. ..... 250/221

* cited by examiner

*Primary Examiner*—Derris H. Banks
*Assistant Examiner*—J Nguyen
(74) *Attorney, Agent, or Firm*—Nields & Lemack

(57) ABSTRACT

An approach sensor 2 is provided to give a signal to a control device, that is, CPU 1, when the approach sensor 2 detects an operator approaching a region predetermined in consideration of a region where a ram 20 is driven. The CPU 1 is operated in response to the signal from the approach sensor 2 to turn a relay 6 off, thereby to intercept the power supply to a servo motor 8 from a power source, wherein the servo motor 8 is controlled to return the ram 20 to an operation point when an instruction is given from an operating device 4 to turn the relay 6 on to supply the power to the servo motor 8 from the power source.

11 Claims, 3 Drawing Sheets

ELECTRIC PRESS

BACKGROUND OF THE INVENTION

Field of the Invention and Related Art Statement

The present invention relates to an electric press.

An electric press driven by an electric motor is generally used in various fields to control the load and position with high precision.

In case the pressing operation is carried out with use of such electric press, it is required to intercept the power supply to the electric press for securing safety when the operator approaches the dangerous region of pressing operation. For example, when the operator enters the dangerous region to change the work to be processed, the power supply to the servomotor of the electric press is manually intercepted. Otherwise an approach sensor or an area sensor is used to detect the operator entering the dangerous region and produce an on signal so that the power supply to the servomotor may be automatically intercepted. After the operator changes the work to be processed and goes out of the dangerous region, the approach sensor or area sensor produces an off signal, or the operator allows the power source to supply power to the electric press with manual operation from the outside of the dangerous region. Thus the press is initialized to start the pressing operation. Such related art is shown in Japanese Patent No. 2533486.

OBJECT OF THE INVENTION

However, the initialization of the electric press is actually a futile operation and is further time consuming. As the result, the operation efficiency is considerably decreased.

It is, therefore, an object of the invention to eliminate the defects and disadvantages of the prior art.

SUMMARY OF THE INVENTION

For attaining the object, the invention has been made. Namely the invention relates to en electric press having a motor, a drive power source for driving the motor, a mechanism for changing the rotation of the motor to straight movement, a ram that is vertically movable with respect to a work to be processed, a position detector for detecting the position of the ram, said invention comprising: a control means for controlling said motor to position said ram at a mechanical fundamental point that is an initial position of said ram and at an operation fundamental point that is optionally set by an operator; a position memory for storing said operation fundamental point therein; a position memory for storing therein the position of said ram and holding said position while said drive power source is turned off; a control means for positioning said ram at said operation fundamental point in accordance with the position of said ram stored in said position memory when said drive power source is turned on after said ram is stopped for safety.

With combination of the constituent elements, the ram may be returned to the operation fundamental point in accordance with the position of the ram stored in the position memory when the drive power source is turned on after the ram is stopped for safety. Thus according to the invention, it is not required, in contrast to the prior art, to initialize the electric press each time the ram is stopped. As the result, the operation efficiency may be considerably increased.

In place of the position memory for holding the stored content, a position detecting means may be used for detecting the position of ram in case the drive power source is turned off. Otherwise, the motor may be so formed as to have a self position detecting ability.

Further, the invention may comprise a means for counting the pressing number of times and a means for detecting whether or not the counted pressing number of times is in accord with a predetermined one, wherein said control means for positioning the ram at the operation fundamental point may position the ram at the mechanical fundamental point instead of the operation fundamental point in case the detecting means detects that the counted pressing number of times is in accord with a predetermined one.

According to the electric press of the invention as mentioned above, the pressing operation may be carried out with high operation efficiency.

DETAILED DESCRIPTION OF THE PREFERRED EMBODIMENTS

The invention will be described in reference to the attached drawings.

Figure 1:
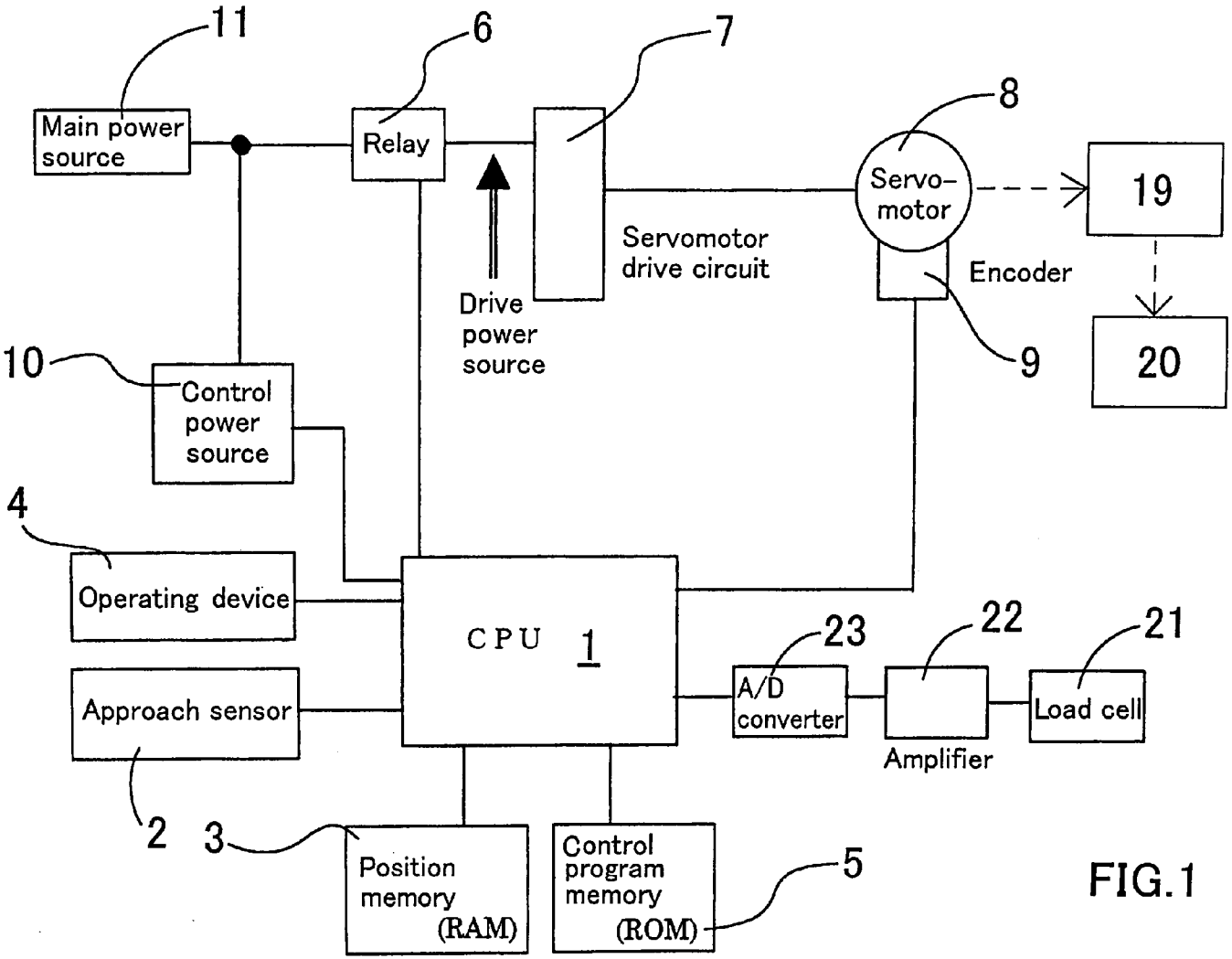
FIG. 1 is a block diagram showing a preferred embodiment of the invention.

FIG. 1 is a block diagram showing the structure of electric press according to the invention.

The electric press is provided with a control device that is a CPU 1 for controlling the operation of the electric press in accordance with programs stored in a control program memory 5. The CPU 1 controls the operation of a servomotor 8 through a control power source 10, a relay 6, and a servomotor drive circuit 7. The servomotor 8 is rotated to operate a straight movement producing mechanism 19 for vertically moving a ram 20 which is connected to the straight movement producing mechanism 19.

The CPU 1 is operated in response to an instruction from an operating device 4 operated by an operator and to a signal from an approach sensor 2 to turn a relay 6 on and off, thereby to make effective and ineffective the power supply from a main power source 11.

The approach sensor 2 is provided to detect anybody approaching a region predetermined in consideration of a driving region in which the ram 20 is driven and give a signal to the CPU 1. The CPU 1 is operated in response to the signal from the approach sensor 2 to turn the relay 6 off, thereby to intercept the power supply to the servomotor 8 from the main power source 11.

The CPU 1 is operated in response to a signal from an encoder 9 representing a rotation quantity of the servomotor 8 and to a signal representing a load of the ram 20, the signal being transmitted through a load cell 21, an amplifier 22 and an A/D converter 23 to the CPU 1, thereby to control the position and speed of the ram 20.

By means of the CPU 1, the operator is able to control the movement of the ram 20 by setting a point at which the ram 20 starts to give pressure and a point at which the ram 20 stops giving pressure.

As the fundamental positions in connection with the ram 20, there are provided an initial position that is a mechanical point and an operation point. The mechanical point is set in connection with the mechanism and unchangeable while the operation point may be optionally changeable.

The position information of the fundamental positions may be stored in a position memory 3. Further, the position information of the ram 20 from the encoder 9 may be successively stored in the position memory 3 which will hold the stored information while the driving power is intercepted. The position memory 3 includes a nonvolatile memory or a memory having a backup power source. With the position memory 3 being used, the ram 20 may be returned to the operation point when the power source becomes on after the same was off.

In this connection, an absolute encoder may be used which will keep the present position of ram as memorized in case the power source is intercepted. Such absolute encoder may be used as attached to the motor.

With the absolute encoder being used, the position of the ram 20 may be detected when the power source becomes on after the same was off. The ram 20 may, therefore, be returned to the operation point when the power source is turned on after the same was off.

Further, a measure may be specially taken to keep the encoder 9 as supplied with power after the power source is turned off. With the special measure being taken, the position of the ram 20 is detected when the power source becomes on after the same was off. The ram 20 may, therefore, be returned to the operation point when the power source is turned on after the same was off.

In response to the signal from the approach sensor 2, the CPU 1 turns the relay 6 off to intercept the power supply to the servomotor 8. Subsequently in response to the instruction from the operating device 4, the CPU 1 turns the relay 6 on to supply power to the servomotor 8 which is then controlled to return the ram 20 to the operation point.

With the combination of the constituent elements, it becomes needless to make initialization of the electric press by returning the ram 20 to the mechanical point each time after change of a work to be processed. It is, therefore, possible to start the pressing operation again from the operation point. Thus the operation efficiency may be considerably increased.

By the way, the ram 20 may be returned to the operation point after the approach sensor 2 produces the approach signal in dependence on the pressing number of times.

For example, the initialization may be made by returning the ram 20 to the mechanical point instead of returning the ram 20 to the operation point in case the pressing number of times is more than a predetermined number of times.

Figure 2:
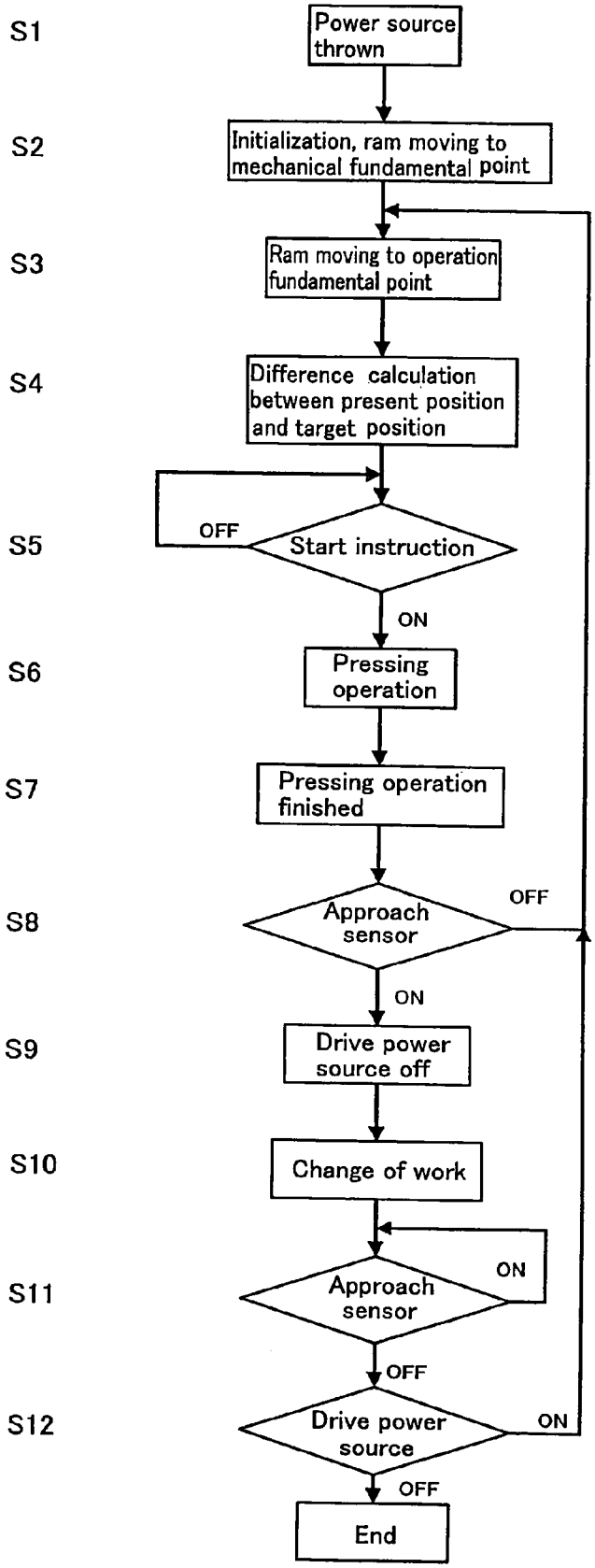
FIG. 2 is a flow chart showing the operation of one embodiment according to the invention.

Now operation will be described in reference to FIG. 2.

When the main power source 11 is thrown (step S1), the initialization is made and the ram 20 is moved to the mechanical point (step S2). Subsequently the ram 20 is moved to the operation point which is set by the operator (step S3), and a difference calculation is made between the present position and the target position (step S4). When the start instruction is given from the operating device 4 (step S5), the pressing operation starts (step S6). When the pressing operation is finished (step S7) and the approach signal is produced from the approach sensor 2 which detects the operator approaching (step S8), the relay 6 is turned off and the drive power source is intercepted (step S9). The operator changes the work to be processed (step S10). When the approach signal becomes off and the instruction is given from the operating device 4 to turn the power source on (steps S11, S12), the routine is returned to the step S3 where the ram 20 is moved to the operation point, such that the same operation may be repeated.

Figure 3:
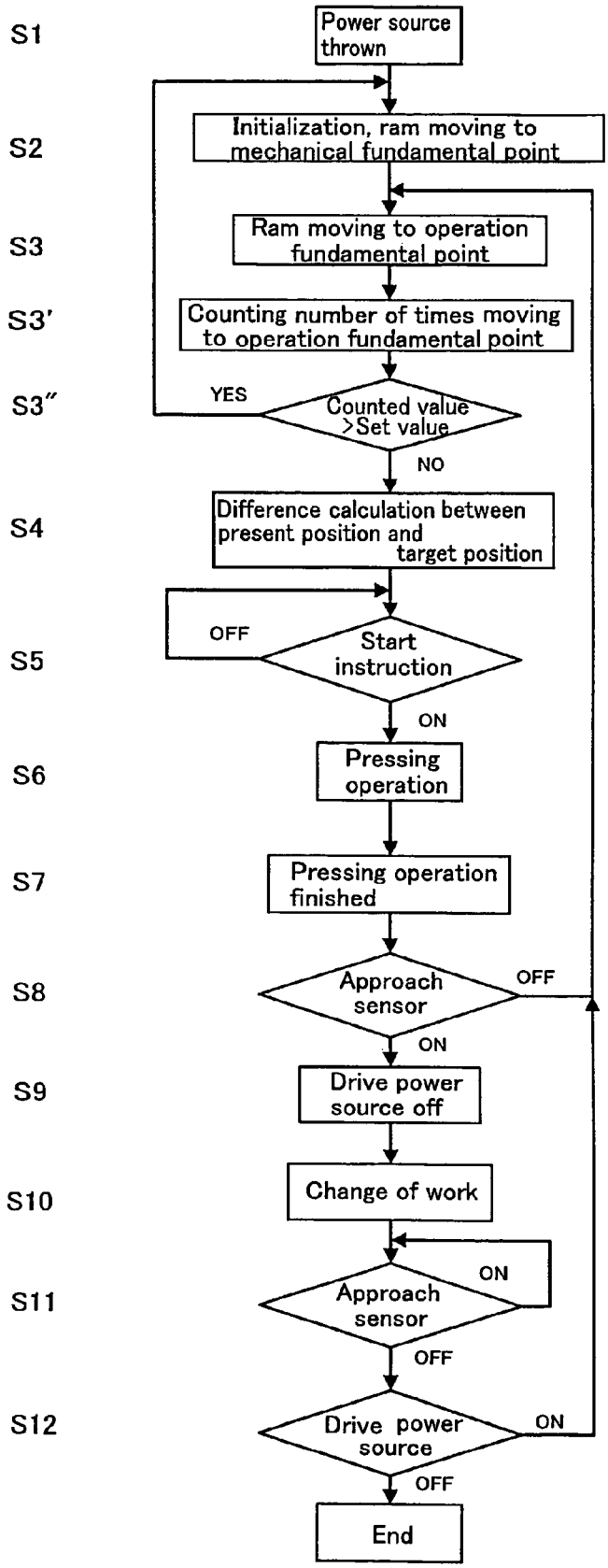
FIG. 3 is a flow chart showing the operation of another embodiment according to the invention.

Now description will be made in reference to FIG. 3 as to the operation of embodiment for selecting the return of ram to the operation point and the mechanical point.

When the main power source 11 is thrown (step S1), the initialization is made, and the ram 20 is moved to the mechanical point (step S2). Subsequently the ram 20 is moved to the operation point which is set by the operator (step S3).

The CPU 1 counts the number of times of the ram 20 moving to the operation point (step S3'). In case the counted value is more than a predetermined one, the routine returns to the step S1 and initialization is made. In case the counted value is less than the predetermined one, the routine goes to the step S4 (step S3"). Then the difference is calculated between the present position and the target position (step S4). When the start instruction is given from the operating device 4 (step S5), the pressing operation is started (step S6). When the pressing operation is finished (step S7) and the approach signal is produced from the approach sensor 2 (step S8), the relay 6 is turned off and the drive power source is intercepted (step S9). Then the operator changes the work to be processed (step S10). When the approach signal becomes off and the signal is given from the operating device 4 to turn the power source on (steps S11, S12), the routine returns to the step S3, and the ram 20 is moved to the operation point or is initialized in dependence on the pressing number of times, such that the ram 20 may repeat the same operation.

The invention thus described, it will be obvious that the same may be varied in many ways. Such variations are not to be regarded as a departure from the spirit and scope of the invention, and all such modifications are intended to be included within the scope of the following claims.

What is claimed is:

1. An electric press having a motor, a drive power source for driving the motor, a mechanism for changing the rotation of the motor to straight movement, a ram that is vertically movable with respect to a work to be processed, and a position detector for detecting the position of the ram, said electric press comprising:

a control means for controlling said motor to position said ram at a mechanical fundamental point, that is an initial position of said ram and at an operation fundamental point that is optionally set by an operator;

a first position memory for storing said operation fundamental point therein;

a second position memory for storing therein the position of said ram at a given point in time and adapted to retain said stored position while said drive power source is turned off;

a control means for positioning said ram at said operation fundamental point in accordance with said position of said ram stored in said second position memory when said drive power source is turned on after said ram is stopped for safety.

2. An electric press having a motor, a drive power source for driving the motor, a mechanism for changing the rotation of the motor to straight movement, a ram that is vertically movable with respect to a work to be processed, said electric press comprising:

a control means for controlling said motor to position said ram at a mechanical fundamental point that is an initial position of said ram and at an operation fundamental point that is optionally set by an operator;

a position memory for storing said operation fundamental point therein;

a position detecting means for detecting the position of said ram at a given point in time;

a control means for positioning said ram at said operation fundamental point in accordance with said operation fundamental point of said ram stored in said position memory and said position of said ram detected by said position detecting means when said drive power source is turned on after said ram is stopped for safety.

3. An electric press having a motor, a drive power source for driving the motor, a mechanism for changing the rotation of the motor to straight movement, and a ram that is vertically movable with respect to a work to be processed, said electric press comprising:

a control means for controlling said motor to position said ram at a mechanical fundamental point that is an initial position of said ram and at an operation fundamental point that is optionally set by an operator;

a position memory for storing said operation fundamental point therein;

said motor having a self position detecting ability;

a control means for positioning said ram at said operation fundamental point in accordance with said operation fundamental point stored in said position memory and the self position detection by said motor.

4. The electric press as defined in claim 1, further comprising;

an approach sensor for detecting anyone approaching a predetermined region where said ram is driven, and a control means which is operated in response to said detection by said approach sensor to turn said drive power source off.

5. The electric press as defined in claim 2, further comprising;

an approach sensor for detecting anyone approaching a predetermined region where said ram is driven, and a control means which is operated in response to said detection by said approach sensor to turn said drive power source off.

6. The electric press as defined in claim 3, further comprising;

an approach sensor for detecting anyone approaching a region predetermined by a region where said ram is driven, and a control means which is operated in response to the detection by said approach sensor to turn said drive power source off.

7. The electric press as defined in claim 1, further comprising;

a counter means for counting the number of times said press has moved to said operation fundamental point, a discriminating means for discriminating whether or not said number of times counted by said counter means is in accord with a predetermined number of times, wherein said control means for positioning said ram at said operation fundamental point positions said ram at said mechanical fundamental point instead of said operation fundamental point in case said discriminating means discriminates said counted number of times being in accord with said predetermined number of times.

8. The electric press as defined in claim 2, further comprising;

a counter means for counting the number of times said press has moved to said operation fundamental point, a discriminating means for discriminating whether or not said number of times counted by said counter means is in accord with a predetermined number of times, wherein said control means for positioning said ram at said operation fundamental point positions said ram at said mechanical fundamental point instead of said operation fundamental point in case said discriminating means discriminates said counted number of times being in accord with said predetermined number of times.

9. The electric press as defined in claim 3, further comprising;

a counter means for counting the number of times said press has moved to said operation fundamental point, a discriminating means for discriminating whether or not said number of times counted by said counter means is in accord with a predetermined number of times, wherein said control means for positioning said ram at said operation fundamental point positions said ram at said mechanical fundamental point instead of said operation fundamental point in case said discriminating means discriminates said counted number of times being in accord with said predetermined number of times.

10. The electric press as defined in claim 1, wherein said position memory holds said operation fundamental point as stored therein while said drive power source is turned off.

11. The electric press as defined in claim 2, wherein said position detecting means may detect the position of said ram in case said drive power source is turned off.

* * * * *